US011814209B2

(12) United States Patent
Hasegawa et al.

(10) Patent No.: US 11,814,209 B2
(45) Date of Patent: Nov. 14, 2023

(54) CAN BODY

(71) Applicant: Universal Can Corporation, Tokyo (JP)

(72) Inventors: Takashi Hasegawa, Sunto-gun (JP); Tomoaki Iimura, Sunto-gun (JP)

(73) Assignee: Universal Can Corporation, Tokyo (JP)

( * ) Notice: Subject to any disclaimer, the term of this patent is extended or adjusted under 35 U.S.C. 154(b) by 202 days.

(21) Appl. No.: 17/299,619

(22) PCT Filed: Nov. 29, 2019

(86) PCT No.: PCT/JP2019/046883

§ 371 (c)(1),
(2) Date: Jun. 3, 2021

(87) PCT Pub. No.: WO2020/116355

PCT Pub. Date: Jun. 11, 2020

(65) Prior Publication Data

US 2022/0017257 A1 Jan. 20, 2022

(30) Foreign Application Priority Data

Dec. 4, 2018 (JP) ..... 2018-226957

(51) Int. Cl.
*B65D 1/02* (2006.01)
*B65D 41/42* (2006.01)

(52) U.S. Cl.
CPC ..... *B65D 1/0246* (2013.01); *B65D 1/0207* (2013.01); *B65D 41/42* (2013.01)

(58) Field of Classification Search
CPC ..... B65D 1/0246; B65D 1/0207; B65D 41/42
See application file for complete search history.

(56) References Cited

U.S. PATENT DOCUMENTS 2,864,528 A 12/1958 Henchert
7,497,350 B2 * 3/2009 Enoki ..... B65D 7/04 220/619

(Continued)

FOREIGN PATENT DOCUMENTS

EP 1468925 A1 10/2004
EP 1001914025 A1 4/2008

(Continued)

OTHER PUBLICATIONS

Extended European Search Report dated Jul. 19, 2022 for the corresponding European Patent Application No. 19893301.2 (11 pages).

(Continued)

*Primary Examiner* — Andrew T Kirsch
(74) *Attorney, Agent, or Firm* — Leason Ellis LLP; Melvin C. Garner; Mitsuhiro Haraguchi

(57) ABSTRACT

A can body has a curl portion to which a skirt portion of a cap is mounted. In the curl portion, an outer periphery upper-side bent portion that forms an outer peripheral portion of a folded-back top portion, an outer periphery-side tubular portion that extends downward in a can axis direction, an outer periphery lower-side bent portion that is bent inward in a radial direction, and a curl end portion that extends from an inner peripheral edge of the outer periphery lower-side bent portion are continuously formed. When a radius of curvature of an outer surface of the outer periphery upper-side bent portion is R5 (mm), a radius of curvature of an outer surface of the outer periphery lower-side bent portion is R6 (mm), and a radius of curvature of an outer surface of the inflection portion is R7 (mm), which is 0.05 to 0.2 mm, R7<R6<R5 is established.

12 Claims, 8 Drawing Sheets

(56) References Cited

U.S. PATENT DOCUMENTS

| | | | |
|---|---|---|---|
| 2012/0024813 | A1 | 2/2012 | Nakagawa et al. |
| 2017/0107020 | A1 | 4/2017 | Vanon |
| 2017/0333970 | A1 | 11/2017 | Chupak et al. |

FOREIGN PATENT DOCUMENTS

| | | | |
|---|---|---|---|
| EP | 2418155 | A1 | 2/2012 |
| JP | 58-161843 | U1 | 10/1983 |
| JP | 2001233332 | A | 8/2001 |
| JP | 2007045505 | A | 2/2007 |
| JP | 2008280065 | A | 11/2008 |
| JP | 2011-116456 | A | 6/2011 |
| JP | 2017-514756 | A | 6/2017 |
| WO | WO-2007/122971 | A1 | 11/2007 |
| WO | 2017177155 | A1 | 10/2017 |
| WO | WO-2018/066308 | A1 | 4/2018 |

OTHER PUBLICATIONS

International Search Report dated Feb. 18, 2020 for the corresponding PCT Patent Application No. PCT/JP2019/046883.

* cited by examiner

CAN BODY

CROSS-REFERENCE TO RELATED PATENT APPLICATIONS

This application is a U.S. National Phase Application under 35 U.S.C. §371 of International Patent Application No. PCT/JP2019/046883 filed on Nov. 29, 2019 and claims the benefit of priority to Japanese Patent Application No. 2018-226957 filed on Dec. 4, 2018, the contents of both of which are incorporated herein by reference in their entireties. The International Application was published in Japanese on Jun. 11, 2020 as International Publication No. WO/2020/116355 under PCT Article 21(2).

FIELD OF THE INVENTION

The present invention relates to a bottle-shaped can body in which a curl portion is formed at an opening portion to which a cap is mounted.

BACKGROUND OF THE INVENTION

As a container that is filled with the contents such as a beverage, there is known a container having a structure in which a cap is mounted to an opening portion of a bottle-shaped can body (bottle can) made of steel, an aluminum alloy, or the like and the inside is sealed with a liner on the inner surface of the cap. Among such can bodies, a container has been proposed in which a curl portion having a shape similar to that of a bottle mouth is formed at an opening portion thereof and the inside of a can body is sealed by mounting a skirt portion of a cap to the curl portion so as to be rolled up. The can body that is used for this container has a curl portion formed relatively large with respect to the opening portion of the can body.

For example, International Publication WO2007/122971 discloses a metal can in which a cap that is opened by cutting off a score by pulling a tab is fastened and fixed to a bead portion (curl portion) formed by curling outward a tip portion of a mouth portion. Then, in International Publication WO2007/122971, the mouth portion extends straight, the bead portion (curl portion) that is formed at the tip portion of the mouth portion is inclined inward, and an inclination starting position thereof is set between a lower end portion of the bead portion and a curl starting position. Further, the curled tip portion of the bead portion (curl portion) is in contact with the outer surface of the mouth portion so as to substantially vertically butt against the outer surface.

In a metal bottle can disclosed in JP-A-2011-116456, there is formed a curl portion having a reduced diameter portion that is reduced in diameter from an upper end of a mouth portion, a rising portion that extends upward from an upper end of the reduced diameter portion, an upper bent portion at an upper end of the rising portion, a curved portion that extends downward while smoothly spreading outward from the upper bent portion and protrudes outward, a lower bent portion at a lower end of the curved portion, and a straight portion that extends linearly from the lower bent portion to the reduced diameter portion. The tip of the straight portion is in contact with the outer surface of the reduced diameter portion. Further, it is described that an inclination angle of the reduced diameter portion is in a range of 25° to 65° , a radius of curvature of the upper bent portion is in a range of 0.5 to 1.0 mm, a radius of curvature of the curved portion is in a range of 2.0 to 3.0 mm, a radius of curvature of the lower bent portion is in a range of 0.5 to 1.0 mm, and the angle of the straight portion with respect to the horizontal is in a range of 0° to 25°.

CITATION LIST

Patent Literature

[Patent Literature 1] International Publication WO2007/122971

[Patent Literature 2] JP-A-2011-116456

Technical Problem

Such a curl portion is formed relatively large in a shape similar to the shape of the bottle mouth. Therefore, a radius of curvature of a lower end portion of the curl portion around which the skirt portion of the cap is rolled up tends to become large, and thus there is a concern that the pressure resistance after the mounting of the skirt portion of the cap may decrease. On the other hand, if the radius of curvature of the lower end portion of the curl portion is reduced, when trying to drink a beverage in the can body, a sharp tip portion hits against the lips, making it difficult to drink the beverage.

The present invention has been made in view of such circumstances, and has an object to provide a can body in which a skirt portion of a cap that is mounted to a curl portion can be reliably rolled up and fixed and there is little discomfort in the lips during drinking.

SUMMARY OF THE INVENTION

Solution to Problem

According to the present invention, there is provided a can body including: a cylindrical body portion, a neck portion having a smaller diameter than the body portion, and a mouth portion connected to the neck portion, in which an outer peripheral portion of the mouth portion has a curl portion in which a tip portion thereof is folded back outward in a radial direction, and in the curl portion, in a longitudinal cross section passing through a can axis, an outer periphery upper-side bent portion that forms an outer peripheral portion of a folded-back top portion, an outer periphery-side tubular portion that extends downward in a can axis direction from a lower end of the outer periphery upper-side bent portion, an outer periphery lower-side bent portion that is bent inward in the radial direction from a lower end of the outer periphery-side tubular portion through an inflection portion, and a curl end portion that extends from an inner peripheral edge of the outer periphery lower-side bent portion while reducing a diameter toward an inner side in the radial direction are continuously formed, and when a radius of curvature of an outer surface of the outer periphery upper-side bent portion is R5 (mm), a radius of curvature of an outer surface of the outer periphery lower-side bent portion is R6 (mm), and a radius of curvature of an outer surface of the inflection portion is R7 (mm), a relationship of R7<R6<R5 is established.

It is preferable that the radius of curvature R7 of the outer surface of the inflection portion is 0.05 mm or more and 0.2 mm or less. Further, it is preferable that the radius of curvature R6 of the outer surface of the outer periphery lower-side bent portion is 0.7 mm or more and 2.0 mm or less.

In the outer peripheral portion of the curl portion, the inflection portion having a small radius of curvature is provided between the outer periphery-side tubular portion and the outer periphery lower-side bent portion, whereby when the skirt portion of the cap is rolled up around the curl portion, the inflection portion can lock the skirt portion of the cap to reliably fix it.

Further, in this curl portion, since the inflection portion is disposed only at a slight portion between the outer periphery-side tubular portion and the outer periphery lower-side bent portion, there is little discomfort to the lips during drinking.

In this case, an outer surface of the outer periphery-side tubular portion is formed in a linear shape or in a curved line shape that is slightly convex outward in the radial direction with a radius of curvature larger than the radius of curvature R5 of the outer surface of the outer periphery upper-side bent portion, in the longitudinal cross section passing through the can axis.

As a suitable embodiment of the can body, a tip of the curl end portion is in contact with an outer surface of a mouth portion starting end portion that is disposed at a starting end position of the mouth portion, in the longitudinal cross section passing through the can axis, and the mouth portion starting end portion is curved so as to be convex outward in the radial direction while gradually reducing a diameter toward the upper side in the can axis direction, and a radius of curvature of the outer surface of the mouth portion starting end portion is 6.3 mm or more and 10.3 mm or less.

Further, the curl end portion is curved so as to be convex inward in the radial direction while gradually reducing a diameter toward the upper side in the can axis direction from the inner peripheral edge of the outer periphery lower-side bent portion, a radius of curvature of an outer surface of the curl end portion is 1.0 mm or more and 4.0 mm or less, and the curved convex outer surface of the tip portion of the curl end portion is in contact with the curved convex outer surface of the mouth portion starting end portion.

Since the tip of the curl end portion of the curl portion is a portion that is processed largest and the elongation of the material is different in each portion in the circumferential direction, there is a case where a circle that is formed by the tip of the curl end portion is not a perfect circle but has a concave-convex shape, when viewed in a cross section orthogonal to the can axis. Therefore, if the tip of the curl end portion is in contact with the outer surface of the mouth portion starting end portion, as described in International Publication WO2007/122971 or JP-A-2011-116456, there is a concern that depending on a position in the circumferential direction, the tip of the curl end portion may bite into the outer surface of the mouth portion starting end portion to damage it, or the portion that first comes into contact with the mouth portion starting end portion may interfere with a curling process, so that the shape of the curl portion becomes partially insufficient.

On the contrary, in the can body of the present embodiment, the mouth portion starting end portion is curved so as to be convex outward in the radial direction, the curl end portion is also curved so as to be convex inward in the radial direction, and these convex outer surfaces are in contact with each other. Therefore, it is possible to prevent the tip portion of the curl end portion from biting into the mouth portion starting end portion or prevent curling from becoming insufficient.

As a suitable embodiment of the can body, when a thickness of the curl portion in the radial direction is T and an outer diameter of the curl portion is D, a ratio (T/D) of the thickness T to the outer diameter D that is 25 mm or more and 40 mm or less is 0.05 or more and 0.18 or less and more preferably, 0.075 or more and 0.16 or less.

It is suitable that the thickness T of the curl portion in the radial direction is 2.0 mm or more and 4.5 mm or less.

As a preferred embodiment of the can body, when a width of the curl portion in the can axis direction is W and an outer diameter of the curl portion is D, the width W is 3.0 mm or more and 5.0 mm or less and more preferably, 3.5 mm or more and 4.7 mm or less, with respect to the outer diameter D that is 25 mm or more and 40 mm or less.

Advantageous Effects of Invention

According to the present invention, a skirt portion of a cap that is mounted to a curl portion can be reliably rolled up and fixed, and there is little discomfort in the lips during drinking.

DETAILED DESCRIPTION OF THE INVENTION

Figure 1:
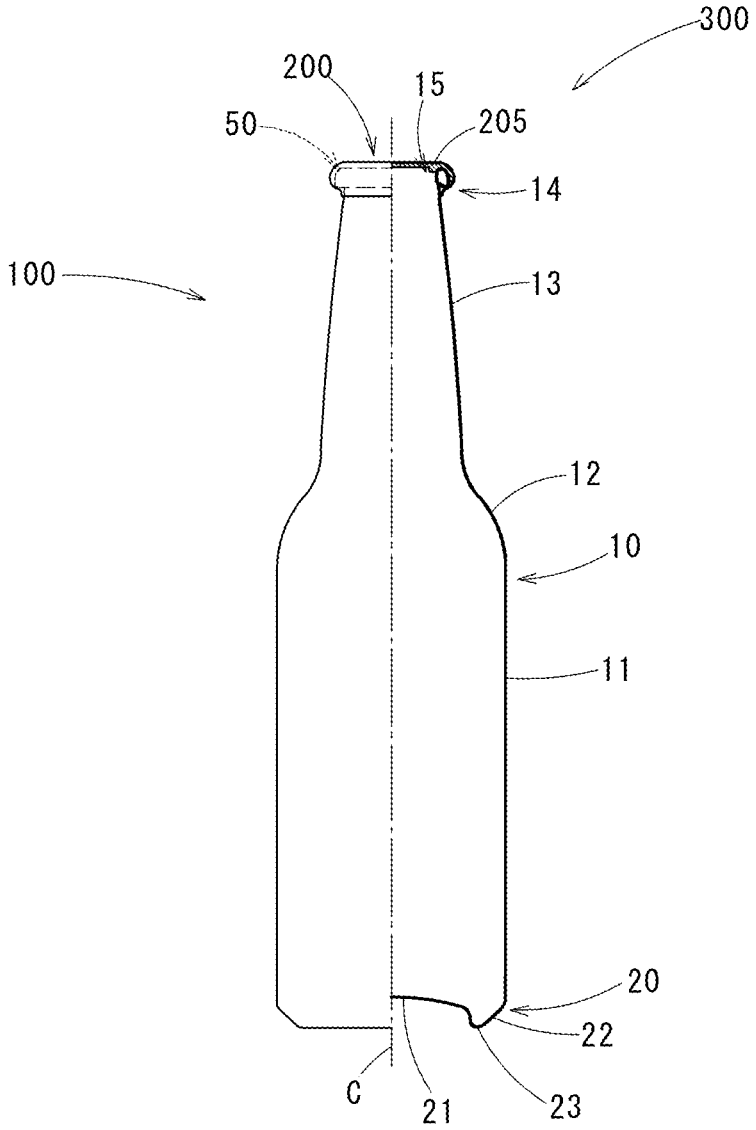
FIG. 1 is a front view showing a bottle container using a can body according to an embodiment of the present invention, in which the right half thereof is a cross section passing through a can axis.
Figure 4:
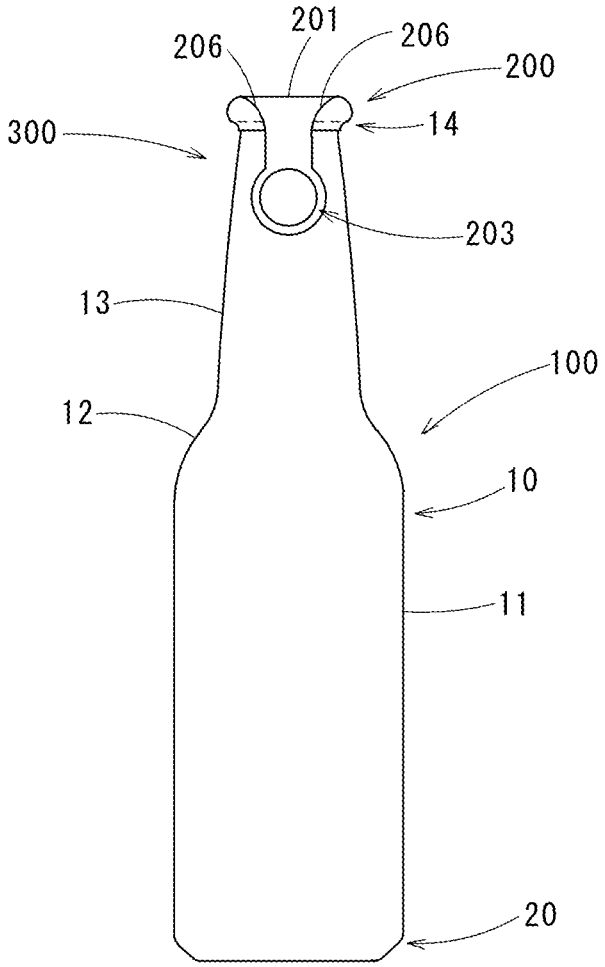
FIG. 4 is a front view of the bottle container of FIG. 1 as viewed from a different angle.
Figure 5:
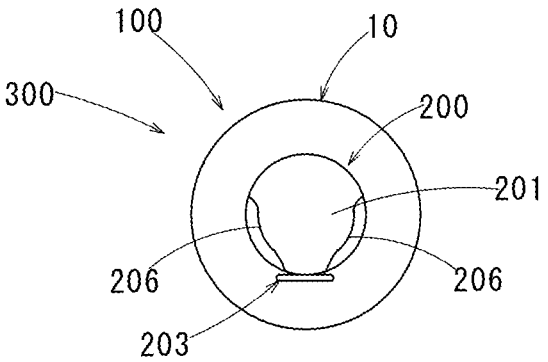
FIG. 5 is a top view of the bottle container shown in FIG. 5.

Hereinafter, an embodiment of a can body according to the present invention will be described with reference to the drawings. As shown in FIGS. 1, 4, and 5, a can body 100 of the present embodiment is a bottle can that is formed in a bottle shape as a whole, and has a curl portion 50 so as to form an opening portion 15 open to the outside, at a mouth portion 14 of an upper end portion thereof. The can body 100 is filled with the contents such as a beverage through the opening portion 15, and then the opening portion 15 is sealed by mounting a cap 200 to the mouth portion 14, and the can body 100 is regarded as a bottle container 300.

FIGS. 1, 4, and 5 show the bottle container 300 that is provided with the can body 100 and the cap 200 mounted to the mouth portion 14 of the can body 100. Further, in FIG. 1, the right half of the bottle container 300 is shown as a cross section passing through a can axis C.

The can body 100 is made of a thin plate metal such as aluminum or an aluminum alloy, and as shown in FIG. 1, the can body 100 is formed in a bottomed cylindrical shape having a bottom portion 20 and a cylindrical body portion 10 which is formed in a straight shape from the bottom portion 20 to an intermediate position in a height direction, and in which an upper portion thereof is reduced in diameter toward the opening portion 15.

As shown in FIG. 1, the body portion 10 and the bottom portion 20 are disposed coaxially with each other, and in the present embodiment, description will be made with a common axis thereof referred to as the can axis C. Further, in a direction along the can axis C (a direction of the can axis C), the direction from the opening portion 15 toward the bottom portion 20 side is defined as the lower side (as being downward), and the direction from the bottom portion 20 toward the opening portion 15 side is defined as the upper side (as being upward), and in the following description, an up-down direction shall be defined in the same manner as the direction shown in FIG. 1. Further, the direction orthogonal to the can axis C is called a radial direction, and in the radial direction, the direction approaching the can axis C is defined as the radially inner side (as being radially inward) and a direction away from the can axis C is defined as the radially outer side (as being radially outward). Further, the direction of orbiting around the can axis C is defined as a circumferential direction.

In the present embodiment, the bottom portion 20 of the can body 100 has a dome portion 21 formed so as to be located on the can axis C and bulge upward (toward the inside of the body portion 10), and a heel portion 22 that connects an outer peripheral edge portion of the dome portion 21 and a lower end portion of the body portion 10. The connection portion between the dome portion 21 and the heel portion 22 is a ground contact portion 23 that comes into contact with a ground contact surface (placing surface) when the can body 100 is placed on the ground contact surface so as to be in an upright posture (a posture in which the opening portion 15 shown in FIG. 1 faces upward). The ground contact portion 23 protrudes most downward at the bottom portion 20 and has an annular shape extending along the circumferential direction.

As shown in FIG. 1, the body portion 10 of the can body 100 has a cylindrical portion 11 formed in a cylindrical shape on the lower portion side (the bottom portion 20 side) of the body portion 10, a shoulder portion 12 whose diameter reduces toward the upper side in the direction of the can axis C so as to be bent inward in the radial direction at the upper end of the cylindrical portion 11, an elongated neck portion 13 that is connected to the upper end of the shoulder portion 12 and extends upward in the direction of the can axis C, and the mouth portion 14 that is connected to the upper end of the neck portion 13 and is open to the outside. The cylindrical portion 11, the shoulder portion 12, the neck portion 13, and the mouth portion 14 each have an annular shape extending over the entire periphery of the body portion 10 in the circumferential direction.

The neck portion 13 has a shape in which a diameter is gradually reduced toward the upper side in the direction of the can axis C, and is formed to have a smaller diameter than the cylindrical portion 11, and the upper end of the neck portion 13 is formed to have the smallest diameter. The height of the neck portion 13 is formed to be slightly smaller than the height of the cylindrical portion 11. In the can body 100 of the present embodiment, the neck portion 13 is formed in a tapered tubular shape that is continuous with the upper end of the shoulder portion 12 and gradually reduces in diameter toward the direction of the can axis C. An upper end portion 13*a* of the neck portion 13 has a small angle with respect to the can axis C and is formed substantially along the direction of the can axis C (refer to FIG. 2). Then, the mouth portion 14 is connected to the upper end of the upper end portion 13*a* of the neck portion 13.

Figure 2:
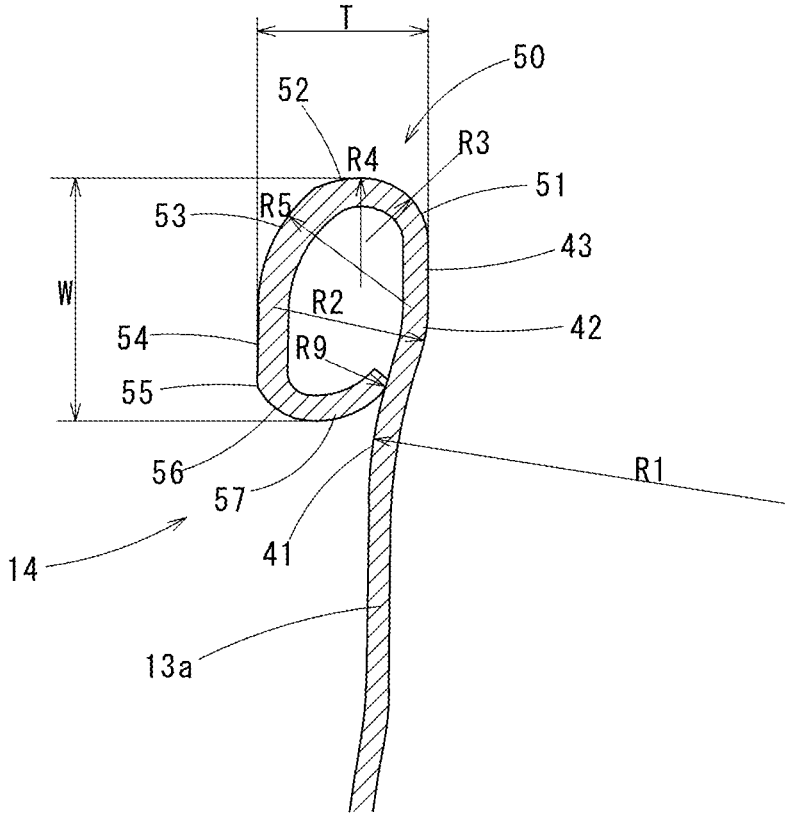
FIG. 2 is an enlarged sectional view of the vicinity of a curl portion of the can body shown in FIG. 1.

As shown in FIG. 2, the mouth portion 14 has a mouth portion starting end portion 41 that is continuous with the upper end portion 13*a* of the shoulder portion 12 and is curved so as to be convex outward in the radial direction while gradually reducing a diameter toward the upper side in the direction of the can axis C, an inner periphery lower-side bent portion 42 that is curved so as to be convex inward in the radial direction from the upper end of the mouth portion starting end portion 41, an inner periphery-side tubular portion 43 that is continuous with the upper end of the inner periphery lower-side bent portion 42 and vertically extends upward in the direction of the can axis C at the innermost diameter position of the mouth portion 14, and the curl portion 50 that is continuous with the upper end of the inner periphery-side tubular portion 43 and is folded outward in the radial direction. In the cross section (longitudinal cross section) passing through the can axis C, the inner periphery-side tubular portion 43 is disposed substantially parallel to the can axis C.

The mouth portion starting end portion 41 is formed such that a radius of curvature R1 (mm) of the outer surface thereof is 6.3 mm or more and 10.3 mm or less, and the inner periphery lower-side bent portion 42 is formed such that a radius of curvature R2 (mm) of the outer surface thereof is 1.0 mm or more and 5.0 mm or less.

In the curl portion 50, in the cross section (longitudinal cross section) passing through the can axis C, an inner periphery upper-side bent portion 51 that is bent so as to extend outward in the radial direction from the upper end of the inner periphery-side tubular portion 43, a folded-back top portion 52 that is bent so as to protrude upward in the can axis direction while being folded back from the outer peripheral edge of the inner periphery upper-side bent portion 51, an outer periphery upper-side bent portion 53 that is bent downward in the direction of the can axis C from the outer peripheral edge of the folded-back top portion 52, an outer periphery-side tubular portion 54 that extends downward in the can axis direction from the outer peripheral edge of the outer periphery upper-side bent portion 53, an outer periphery lower-side bent portion 56 that is bent inward in the radial direction from the lower end of the outer periphery-side tubular portion 54 through an inflection portion 55, and a curl end portion 57 that extends from the outer periphery lower-side bent portion 56 while reducing a diameter toward the inner side in the radial direction are continuously formed. The folded-back top portion 52 that is disposed between the inner periphery upper-side bent portion 51 and the outer periphery upper-side bent portion 53 is disposed at the uppermost end position in the curl portion 50.

A radius of curvature R3 (mm) of the outer surface of the inner periphery upper-side bent portion 51 is 0.8 mm or more and 1.4 mm or less, a radius of curvature R4 (mm) of the outer surface of the folded-back top portion 52 is 1.5 mm or more and 2.5 mm or less, and a radius of curvature R5 (mm) of the outer surface of the outer periphery upper-side bent portion 53 is 2.4 mm or more and 3.0 mm or less.

Figure 3:
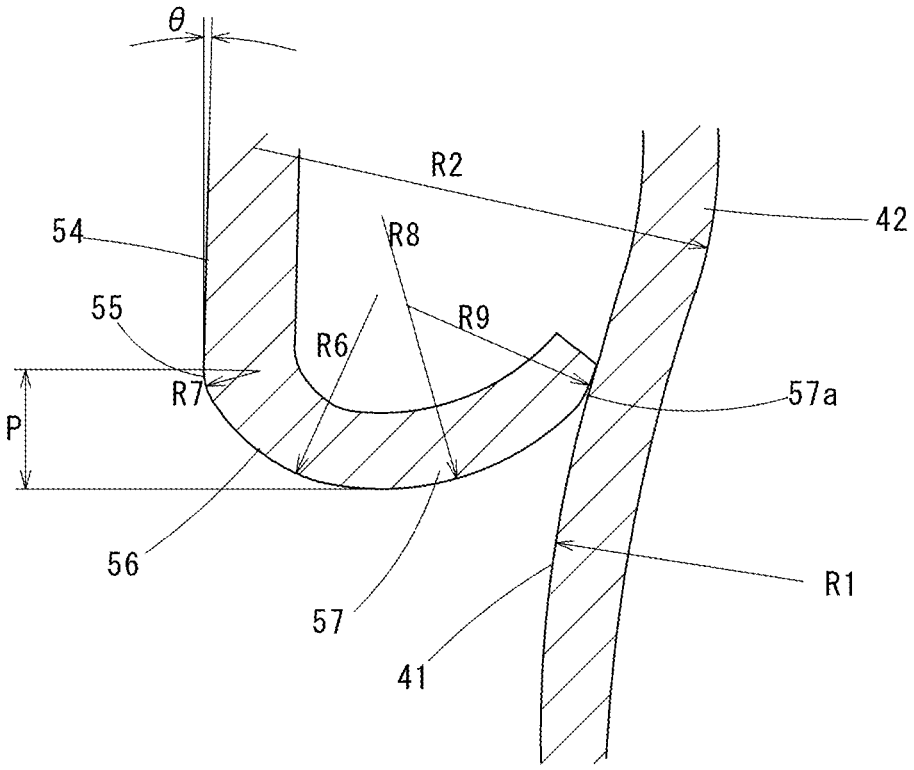
FIG. 3 is a further enlarged sectional view of the vicinity of a lower portion of the curl portion shown in FIG. 2.

In the present embodiment, as shown in FIG. 3, the outer periphery-side tubular portion 54 is formed so as to slightly increase a diameter toward the lower side in the direction of the can axis C, and an angle θ of the inclination with respect to the can axis C is 1.2° or more and 1.8° or less. A radius of curvature R6 (mm) of the outer surface of the outer periphery lower-side bent portion 56 is 0.7 mm or more and 2.0 mm or less.

The inflection portion 55 is provided at a slight portion between the lower end of the outer periphery-side tubular portion 54 and the upper end of the outer periphery lower-side bent portion 56, and a radius of curvature R7 (mm) of the outer surface thereof is 0.05 mm or more and 0.2 mm or less. Therefore, the inflection portion 55 is formed in a linear shape along the circumferential direction with a slight width between the lower end of the outer periphery-side tubular portion 54 and the upper end of the outer periphery lower-side bent portion 56.

Further, as described above, since the outer periphery-side tubular portion 54 is formed to slightly increase a diameter toward the lower side in the can axis direction, the inflection portion 55 that is continuous with the lower end thereof is disposed on the outermost side in the radial direction in the curl portion 50. In this case, since the inflection portion 55 is continuous with the lower end of the slightly inclined outer periphery-side tubular portion 54 and is connected to the upper end of the outer periphery lower-side bent portion 56, the vicinity of the starting end portion of the inflection portion 55 is disposed on the outermost side in the radial direction. Since the width of the inflection portion 55 is small, in reality, the inflection portion 55 may be regarded as being a linear shape along the circumferential direction.

If the radius of curvature R7 of the inflection portion 55 exceeds 0.2 mm, the locking when the skirt portion of the cap 200 is rolled up becomes weak, and thus the sealing property is impaired. If the radius of curvature R7 is less than 0.05 mm, forming failure such as cracking of the inflection portion 55 occurs.

In the outer surface of the curl portion 50, if the radius of curvature R5 of the outer periphery upper-side bent portion 53 exceeds 3.0 mm, there is a concern that the sealing property may decrease, and if the radius of curvature R5 of the outer periphery upper-side bent portion 53 is less than 2.48 mm, there is a concern that cracks or wrinkles may occur during the forming of the curl portion 50. Further, if the radius of curvature R6 of the outer periphery lower-side bent portion 56 exceeds 2.0 mm, there is a concern that the rolled-up of the skirt portion of the cap 200 may become weak. On the other hand, if the radius of curvature R6 is less than 0.7 mm, there is a concern that cracks or wrinkles may occur in the curl portion 50 during the forming process of the curl portion 50.

With respect to the radius of curvature R5 of the outer surface of the outer periphery upper-side bent portion 53, the radius of curvature R6 of the outer surface of the outer periphery lower-side bent portion 56, and the radius of curvature R7 of the outer surface of the inflection portion 55, the relationship of R7<R6<R5 is established.

The curl end portion 57 is curved so as to be convex inward in the radial direction while gradually reducing a diameter toward the upper side in the direction of the can axis C from the inner peripheral edge of the outer periphery lower-side bent portion 56, and a radius of curvature R8 (mm) of the outer surface thereof is 1.0 mm or more and 4.0 mm or less. In the present embodiment, only a tip portion 57*a* of the curl end portion 57 is formed to have a smaller radius of curvature. A radius of curvature R9 (mm) of the tip portion 57*a* is 0.8 mm or more and 3.0 mm or less. Therefore, the outer surface of the curl end portion 57 forms a convex outer surface in which the curved surface of the radius of curvature R8 and the curved surface of the radius of curvature R9 are continuous. The radii of curvature R8 and R9 of the curl end portion 57 may have the same dimension.

Since the mouth portion starting end portion 41 is also curved so as to be convex outward in the radial direction, as described above, the outer surface thereof forms a convex outer surface. Then, the tip of the curl end portion 57 extends toward a midway position in the direction of the can axis C in the mouth portion starting end portion 41, and the convex outer surface of the tip portion 57*a* of the curl end portion 57 is in contact with the convex outer surface of the mouth portion starting end portion 41.

As shown in FIG. 2, a width W (mm) of the curl portion 50 in the direction of the can axis C is regarded as the vertical distance parallel to the can axis C from the upper end position of the curl portion 50 in the direction of the can axis C to the lower end position of the curl portion 50. In the cross section passing through the can axis C, the folded-back top portion 52 is disposed at the uppermost end position of the curl portion 50 in the direction of the can axis C, the connection portion between the outer periphery lower-side bent portion 56 and the curl end portion 57 is disposed at the lowermost end position of the curl portion 50 in the direction of the can axis C, and the width W of the curl portion 50 is regarded as the vertical distance from the outer surface of the upper end of the folded-back top portion 52 to the connection portion between the outer periphery lower-side bent portion 56 and the curl end portion 57.

A thickness T (mm) of the curl portion 50 in the radial direction is regarded as the horizontal distance orthogonal to the can axis C from the innermost diameter position to the outermost diameter position of the curl portion 50 in the radial direction. In the longitudinal cross section passing through the can axis C shown in FIG. 2, the starting end of the inner periphery upper-side bent portion 51, in other words, the position of upper end of the inner periphery-side tubular portion 43 is disposed at the innermost position in the radial direction of the curl portion 50, and the inflection portion 55 is disposed at the outermost position in the radial direction of the curl portion 50. Therefore, the thickness T is regarded as the horizontal distance from the inner surface of the starting end of the inner periphery upper-side bent portion 51 to the outer surface of the inflection portion 55.

A height P (mm) from the lowermost end of the curl portion 50 to the connection portion between the inflection portion 55 and the outer periphery-side tubular portion 54 shown in FIG. 3 (the distance from the connection portion between the outer periphery lower-side bent portion 56 and the curl end portion 57 to the connection portion between the inflection portion 55 and the outer periphery-side tubular portion 54), within the width W of the curl portion 50 in the direction of the can axis C, is 0.5 mm or more and 0.9 mm or less.

In the present embodiment, when the outer diameter of the curl portion 50 is D (mm) (refer to FIG. 7C), the ratio (T/D) of the thickness T to the outer diameter D is 0.05 or more and 0.18 or less, and the thickness T of the curl portion 50 is formed to have a size of 5% or more and 18% or less of the outer diameter D. Specifically, for example, in the can body 100 in which the outer diameter D of the curl portion 50 is 25 mm or more and 40 mm or less, the thickness T of the curl portion 50 is 2.0 mm or more and 4.5 mm or less and preferably, 3.0 mm or more and 4.0 mm or less.

Further, in the can body 100, in a case where the outer diameter D of the curl portion 50 is 25 mm or more and 40 mm or less, the width W of the curl portion 50 is 3.0 mm or more and 5.0 mm or less and preferably, 3.5 mm or more and 4.7 mm or less.

In FIGS. 2 and 3, the outer periphery-side tubular portion 54 is formed so as to gradually increase a diameter toward the lower side in the direction of the can axis C. However, it may be formed parallel to the direction of the can axis C. Alternatively, the outer periphery-side tubular portion 54 may be formed in a curved surface that is gently curved outward in the radial direction with the radius of curvature sufficiently larger than the radius of curvature R5 of the outer periphery upper-side bent portion 53 while gradually increasing a diameter toward the lower side in the direction of the can axis C. That is, the outer periphery-side tubular portion 54 is formed in a inear shape or in a curved line shape that is slightly convex outward in the radial direction with the radius of curvature larger than the radius of curvature R5 of the outer surface of the outer periphery upper-side bent portion 53, in the longitudinal cross section passing through the can axis C.

The plate thickness of the can body 100 is not necessarily limited. However, the original plate thickness of an aluminum alloy plate before forming is in a range of 0.250 mm to 0.500 mm, and the plate thickness in the curl portion 50 is in a range of 0.200 mm to 0.600 mm.

Figure 6A:
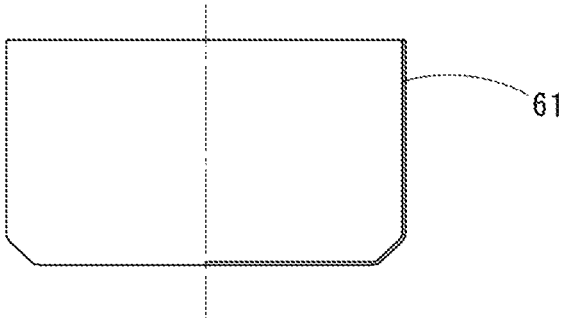
FIGS. 6A and 6B are front views showing the first half of a manufacturing process of the can body in order, in which the right half is a cross section.
Figure 6B:
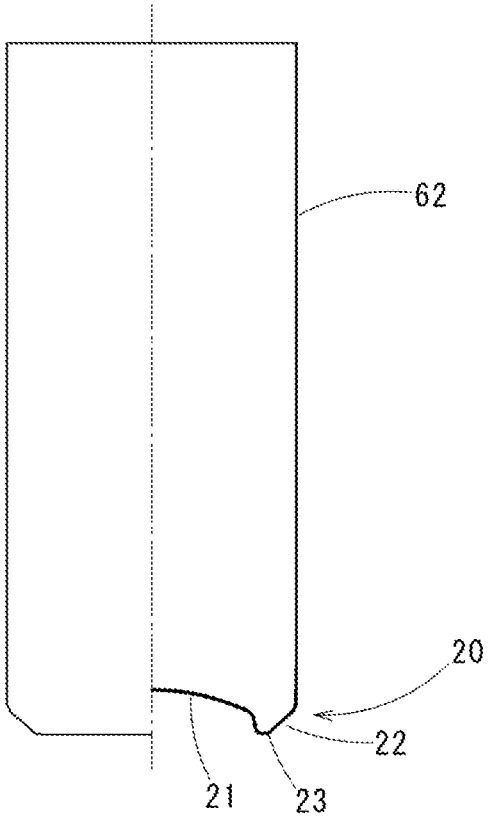

In order to manufacture the can body 100 that is configured as described above, first, as shown in FIG. 6A, a cup 61 is formed by drawing a thin plate of an aluminum alloy or the like, and then, as shown in FIG. 6B, the cup 61 is formed into a tubular body 62 by drawing ironing (DI processing). By this processing, the bottom portion 20 is also formed.

Figure 7A:
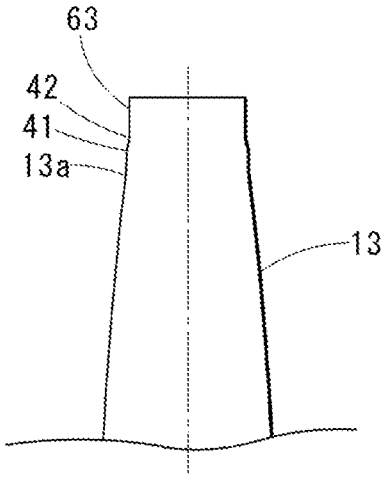
FIGS. 7A, 7B and 7C are front views showing the latter half of the manufacturing process of the can body in order, in which the right half is a cross section.

Subsequently, as shown in FIG. 7A, the shoulder portion 12 and the neck portion 13 are formed by reducing the diameter of the upper portion of the tubular body 62 by die necking processing. At this step, the mouth portion starting end portion 41 is continuously formed at the upper end portion 13*a* of the neck portion 13, and a tubular portion 63 having substantially the same outer diameter as the inner periphery-side tubular portion 43 is formed at the upper end of the mouth portion starting end portion 41 through the inner periphery lower-side bent portion 42.

Figure 7B:
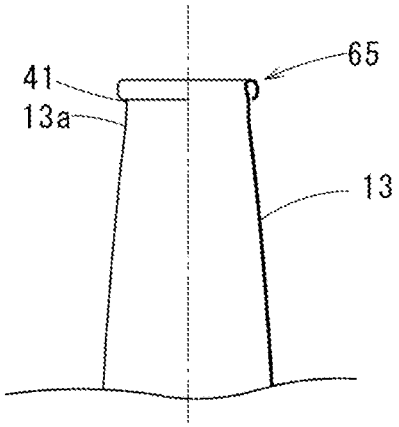
Figure 7C:
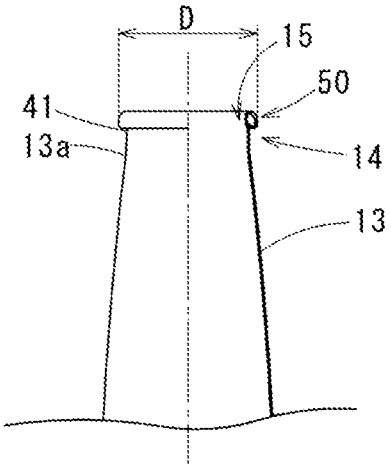
Figure 8:
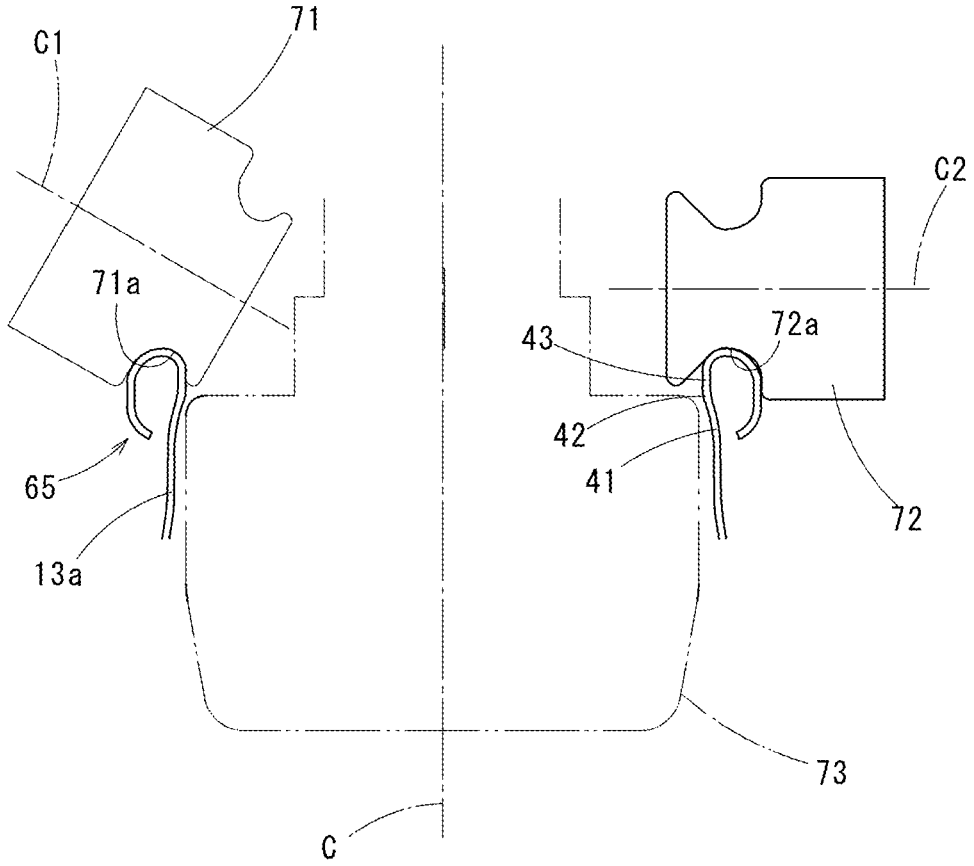
FIG. 8 is a sectional view showing a state of being processed by a rolling tool in a curling process.

Subsequently, in the tubular portion 63, as shown in FIGS. 7B and 8, curling processing is performed on a portion above the portion that becomes the inner periphery-side tubular portion 43. In this curling processing, first, a rolled portion 65 rolled to be continuous with the inner periphery-side tubular portion 43 is formed by folding back an opening end portion of the tubular portion 63 while expanding the opening end portion by two types of rolling tools 71 and 72.

The rolling tools 71 and 72 are rotatable around axes C1 and C2, respectively, have shaping grooves 71*a* and 72*a* along the circumferential direction thereof, and process the tubular portion 63 by the shaping grooves 71*a* and 72*a* while rotating around the tubular portion 63. Further, a core 73 that supports the tubular portion 63 from the inside is inserted into the tubular portion 63.

The rolled portion 65 formed by this processing has an outer shape slightly larger than the final shape of the curl portion 50, and at this step, the tip of the rolled portion 65 is not in contact with the outer surface of the inner periphery-side tubular portion 43.

Figure 9:
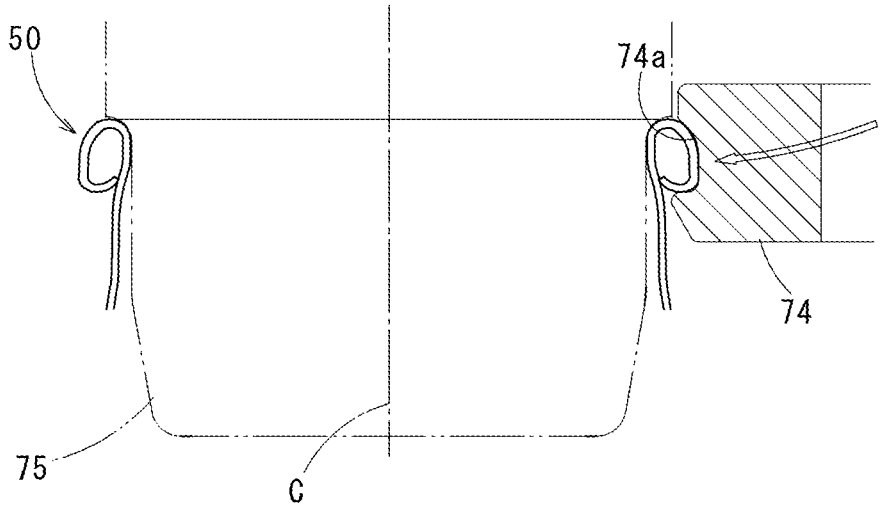
FIG. 9 is a sectional view showing a state of being processed by a shaping tool in the curling process.

Subsequently, a shaping tool 74 is brought close to the rolled portion 65 while drawing an arc, as shown by a void arrow in FIG. 9, and presses the outer surface of the rolled portion 65 inward in the radial direction so as to lift the outer surface from diagonally below. The shaping tool 74 is also rotatable around an axis (not shown), has a shaping groove 74*a* along the circumferential direction thereof, and processes the rolled portion 65 by the shaping groove 74*a* while rotating around the rolled portion 65. Also at this time, a core 75 is disposed inside the rolled portion 65 to support the rolled portion 65 from the inside.

Figure 10:
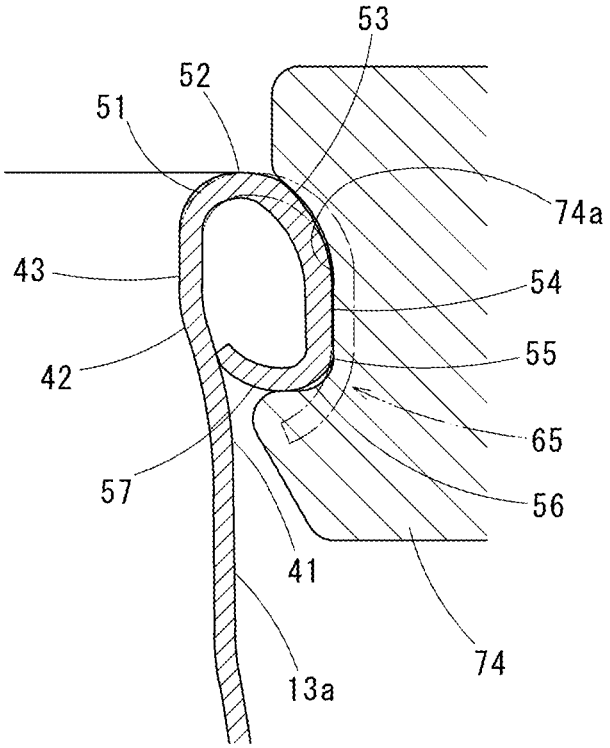
FIG. 10 is an enlarged sectional view of a main part of FIG. 9.

Due to the processing by the shaping tool 74, the outer peripheral portion of the rolled portion 65 is mainly shaped, as shown in FIG. 10, and thus the folded-back top portion 52, the outer periphery upper-side bent portion 53, the outer periphery-side tubular portion 54, the inflection portion 55, the outer periphery lower-side bent portion 56, and the curl end portion 57 are formed through the inner periphery upper-side bent portion 51 continuous with the upper end of the inner periphery-side tubular portion 43.

In this case, the shaping tool 74 pushes the outer surface side of the rolled portion 65 so as to lift it from diagonally below, so that the inflection portion 55 having a small radius of curvature R7 is formed between the outer periphery-side tubular portion 54 and the outer periphery lower-side bent portion 56 and the curl end portion 57 is formed in a curved state with the radii of curvature R8 and R9.

In this way, the curl portion 50 is formed in a state where the outer surface of the tip portion 57*a* of the curl end portion 57 is in contact with the outer surface of the mouth portion starting end portion 41.

Since the outer surface of the tip portion 57*a* of the curl end portion 57 is curved, it becomes a convex outer surface, and on the other hand, since the mouth portion starting end portion 41 is also formed to have a convex outer surface, these convex outer surfaces come into contact with each other, and thus it is possible to prevent the tip of the curl end portion 57 from biting into the mouth portion starting end portion 41 or prevent the occurrence of forming failure such as insufficient curling due to butting against the outer surface of the mouth portion starting end portion 41.

In the can body 100 configured in this way, as shown in FIGS. 1, 4, and 5, the cap 200 is mounted to the opening portion 15 of the mouth portion 14, and thus the bottle container 300 is formed. Specifically, after the inside of the can body 100 is filled with the contents, the mouth portion 14 is covered with the cap 200. Then, in a state where the cap 200 is pressed toward the lower side in the direction of the can axis C from above, so that a seal material 205 mounted to the inner surface of the cap 200 is compressed, a lower end portion of a skirt portion (tubular portion) of the cap 200 is pressed inward in the radial direction by a claw of a tool, whereby the skirt portion is deformed so as to follow the outer surface of the curl portion 50. In this way, the lower end portion of the skirt portion is rolled up so as to be hooked on the lower end portion of the curl portion 50, and thus the cap 200 is mounted to the can body 100.

In the present embodiment, as shown in FIGS. 4 and 5, the cap 200 is made of a thin plate metal of aluminum or an aluminum alloy, and has a disk-shaped top surface portion 201, a skirt portion extending vertically downward from the outer peripheral edge of the top surface portion 201, a tab 203 protruding so as to extend a part of the lower edge of the skirt portion in a plane direction, and the seal material 205 formed from the inner surface of the top surface portion 21 to the inner surface of the upper end portion of the skirt portion. A pair of scores 206 is formed on the outer surfaces of the top surface portion 201 and the skirt portion from both side edges of the tab 203 in the lower edge of the skirt portion to the skirt portion and the top surface portion 201.

In the mounted state of the cap 200, in the lower end portion of the curl portion 50, the inflection portion 55 is connected to the lower end of the outer periphery-side tubular portion 54 and the outer periphery lower-side bent portion 56 is connected to the inflection portion 55. Therefore, the skirt portion of the cap 200 is rolled up over the range from the lower end portion of the outer periphery-side tubular portion 54 to the starting end portion of the outer periphery lower-side bent portion 56 (the vicinity of the connection portion with the inflection portion 55). At the portion where the skirt portion of the cap 200 is rolled up, the inflection portion 55 having a small radius of curvature R7 is provided to configure the maximum diameter portion of the curl portion 57, and therefore, the skirt portion of the cap 200 is locked to the inflection portion 55 to be prevented from being separated from the curl portion 50.

Further, since the inflection portion 55 is disposed only at a slight portion between the outer periphery-side tubular portion 54 having a tubular shape and the outer periphery lower-side bent portion 56 curved with the relatively large radius of curvature R6, there is little discomfort in the lips during drinking.

The present invention is not limited to the configuration of the above-embodiment, and in the detailed configuration, various changes can be made within a scope which does not depart from the gist of the present invention.

For example, in the above embodiment, the bottomed cylindrical can body in which the bottom portion 20 and the body portion 10 are integrally formed has been described. However, a can body that does not necessarily have a bottom portion is also included, and a can body in which after a curl portion is formed, a separately formed bottom portion is wrapped around and fastened to a body portion is also included.

INDUSTRIAL APPLICABILITY

A can body can be provided in which a skirt portion of a cap that is mounted to a curl portion can be reliably rolled up and fixed and there is little discomfort in the lips during drinking.

REFERENCE SIGNS LIST

10: body portion
11: cylindrical portion
12: shoulder portion
13: neck portion
13*a*: upper end portion
14: mouth portion
15: opening portion
20: bottom portion
21: dome portion
22: heel portion
23: ground contact portion
41: mouth portion starting end portion
42: inner periphery lower-side bent portion
43: inner periphery-side tubular portion
50: curl portion
51: inner periphery upper-side bent portion
52: folded-back top portion
53: outer periphery upper-side bent portion
54: outer periphery-side tubular portion
55: inflection portion
56: outer periphery lower-side bent portion
57: curl end portion
100: can body
200: cap
201: top surface portion
300: bottle container
C: can axis

The invention claimed is:

1. A can body comprising:

a body portion that has a cylindrical shape;

a neck portion having a smaller diameter than the body portion; and a mouth portion connected to the neck portion, wherein an outer peripheral portion of the mouth portion has a curl portion in which a tip portion thereof is folded back outward in a radial direction, in the curl portion, in a longitudinal cross section passing through a can axis, an outer periphery upper-side bent portion that forms an outer peripheral portion of a folded-back top portion, an outer periphery-side tubular portion that extends downward in a can axis direction from a lower end of the outer periphery upper-side bent portion, an outer periphery lower-side bent portion that is bent inward in the radial direction from a lower end of the outer periphery-side tubular portion through an inflection portion, and a curl end portion that extends from an inner peripheral edge of the outer periphery lower-side bent portion while reducing a diameter toward an inner side in the radial direction are continuously formed, the inflection portion is disposed on the outermost side of the curl portion in the radial direction and is formed as a linear shape along a circumferential direction, when a radius of curvature of an outer surface of the outer periphery upper-side bent portion is R5 (mm), a radius of curvature of an outer surface of the outer periphery lower-side bent portion is R6 (mm), and a radius of curvature of an outer surface of the inflection portion is R7 (mm), a relationship of R7<R6<R5 is established, and the radius of curvature R7 of the outer surface of the inflection portion is 0.05 mm or more and 0.2 mm or less.

2. The can body according to claim 1, wherein the radius of curvature R6 of the outer surface of the outer periphery lower-side bent portion is 0.7 mm or more and 2.0 mm or less.

3. The can body according to claim 1, wherein an outer surface of the outer periphery-side tubular portion is formed in a linear shape or in a curved line shape that is slightly convex outward in the radial direction with a radius of curvature larger than the radius of curvature R5 of the outer surface of the outer periphery upper-side bent portion, in the longitudinal cross section passing through the can axis.

4. The can body according to claim 1, wherein a tip of the curl end portion is in contact with an outer surface of a mouth portion starting end portion that is disposed at a starting end position of the mouth portion, in the longitudinal cross section passing through the can axis, and the mouth portion starting end portion is curved so as to be convex outward in the radial direction while gradually reducing a diameter toward an upper side in the can axis direction, and a radius of curvature of the outer surface of the mouth portion starting end portion is 6.3 mm or more and 10.3 mm or less.

5. The can body according to claim 1, wherein a tip of the curl end portion is in contact with an outer surface of a mouth portion starting end portion that is disposed at a starting end position of the mouth portion, in the longitudinal cross section passing through the can axis, the curl end portion is curved so as to be convex inward in the radial direction while gradually reducing a diameter toward an upper side in the can axis direction from the inner peripheral edge of the outer periphery lower-side bent portion, and a radius of curvature of an outer surface of the curl end portion is 1.0 mm or more and 4.0 mm or less, and a curved convex outer surface of a tip portion of the curl end portion is in contact with a curved convex outer surface of the mouth portion starting end portion.

6. The can body according to claim 1, wherein when a thickness of the curl portion in the radial direction is T and an outer diameter of the curl portion is D, a ratio (T/D) of the thickness T to the outer diameter D that is 25 mm or more and 40 mm or less is 0.05 or more and 0.18 or less.

7. The can body according to claim 1, wherein when a thickness of the curl portion in the radial direction is T and an outer diameter of the curl portion is D, a ratio (T/D) of the thickness T to the outer diameter D that is 25 mm or more and 40 mm or less is 0.075 or more and 0.16 or less.

8. The can body according to claim 1, wherein when a width of the curl portion in the can axis direction is W and an outer diameter of the curl portion is D, the width W is 3.0 mm or more and 5.0 mm or less with respect to the outer diameter D that is 25 mm or more and 40 mm or less.

9. The can body according to claim 1, wherein when a width of the curl portion in the can axis direction is W and an outer diameter of the curl portion is D, the width W is 3.5 mm or more and 4.7 mm or less with respect to the outer diameter D that is 25 mm or more and 40 mm or less.

10. The can body according to claim 1, wherein when a thickness of the curl portion in the radial direction is T and an outer diameter of the curl portion is D, the outer diameter of the curl portion, the outer diameter D of the curl portion is 25 mm or more and 40 mm or less, and the thickness T of the curl portion in the radial direction is 2.0 mm or more and 4.5 mm or less.

11. The can body according to claim 10, wherein the thickness T of the curl portion is 3.0 mm or more and 4.0 mm or less.

12. The can body according to claim 1, wherein a diameter of the outer periphery-side tubular portion is slightly increased toward a lower side in the direction of the can axis.

* * * * *